US006589094B2

(12) United States Patent
Spencer

(10) Patent No.: US 6,589,094 B2
(45) Date of Patent: Jul. 8, 2003

(54) HAND HELD LIGHT DISPLAY

(76) Inventor: Jerrald D. Spencer, 1941 Lakemont, Spanish Lake, MO (US) 63138

( * ) Notice: Subject to any disclaimer, the term of this patent is extended or adjusted under 35 U.S.C. 154(b) by 0 days.

(21) Appl. No.: 09/829,539

(22) Filed: Apr. 9, 2001

(65) Prior Publication Data

US 2002/0146960 A1 Oct. 10, 2002

(51) Int. Cl.[7] ..... A63H 33/22; A63H 33/26

(52) U.S. Cl. ..... 446/242; 40/432; 362/35; 446/71; 446/219; 446/485

(58) Field of Search ..... 40/432; 362/35; 446/71, 219, 242, 485

(56) References Cited

U.S. PATENT DOCUMENTS 2,055,777 A 9/1936 Shigley
5,030,160 A 7/1991 Klawitter ..... 446/242
5,084,803 A * 1/1992 Lan ..... 362/35
5,269,719 A * 12/1993 Klawitter et al. ..... 446/485
5,385,062 A * 1/1995 Menke ..... 362/35 X
5,426,417 A * 6/1995 Stanuch

* cited by examiner

*Primary Examiner*—John A. Ricci
(74) *Attorney, Agent, or Firm*—Polster, Lieder, Woodruff & Lucchesi, L.C.

(57) ABSTRACT

A portable, hand-held light display that has a handle or barrel, a transparent enclosure mounted on the handle and a light display mounted for rotation on the handle, visible through the transparent enclosure, the light display having a first rotating support, at least one light support rotatably mounted on the first rotating support, and lamps mounted on the light support.

7 Claims, 3 Drawing Sheets

HAND HELD LIGHT DISPLAY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Light display devices in which lamps of various sorts have been rotated about two, offset axes to produce different patterns, have been known for many years. Shigley U.S. Pat. No. 2,055,777 is an example of an early motor driven device. Klawitter patent U.S. Pat. No. 5,030,160 is an example of a mechanically driven device. None of the devices of the prior art, to the best of Applicant's knowledge, have been hand-held.

One of the objects of this invention is to provide a lighting device in which one or more lights is rotated about two axes, which device is small and adapted to be hand-held.

Other objects will become apparent to those skilled in the art in the light of the following description and accompanying drawings.

BRIEF SUMMARY OF THE INVENTION

In accordance with this invention, generally stated, a hand-held light display device is provided which, in the embodiments shown, takes the form of a ball-point pen, although the device can take other forms, from a baby's rattle to a baton.

The device has a barrel or handle, a transparent enclosure mounted on the handle and a light display mounted for rotation on the handle, visible through the transparent enclosure. The light display has a first rotating support and means for rotating that support. At least one light support is rotatably mounted on the first support, lamps are mounted on the light support, and means are provided for rotating the light support with respect to the first support when the first support is rotated. The lamps are thus rotated about two different axes, the axis of rotation of the first support and the axis of rotation of the light support. In the embodiments described, the first support is driven by a motor powered by batteries contained in the barrel. In the first embodiment, the light support is in the form of discs mounted for rotation on shafts carried by the first support, and rotated by virtue of the engagement of a roller with a rim of a fixed dish, the lamps being powered by the same batteries that power the motor, through brushes, sliding contacts, the use of which has been known since before Shigley patent U.S. Pat. No. 2,055,777.

In a second embodiment, a bracket, carried by the first support, carries a motor with a shaft extending perpendicularly to the axis of rotation of the first support, and rotating the light support. In the embodiment shown and described, both motors are powered by batteries contained in the barrel or handle.

In both embodiments described, the barrel or handle is the stem of an oversized ball-point pen. In one embodiment, the cartridge of the ball-point pen serves as a plunger to close a switch energizing a motor driving a first rotating disc.

In another embodiment, in which two motors are employed, one to rotate the first support, and the other, mounted on the first support, driving a light support, on which lamps are mounted on an axis of rotation perpendicular to the axis of rotation of the first support, the barrel is also illustrated as being part of a ball point pen, but the cartridge of the pen does not serve the function of a switch actuator, a separate switch being provided, mounted in the side wall of the barrel.

DETAILED DESCRIPTION OF THE INVENTION

Figure 1:
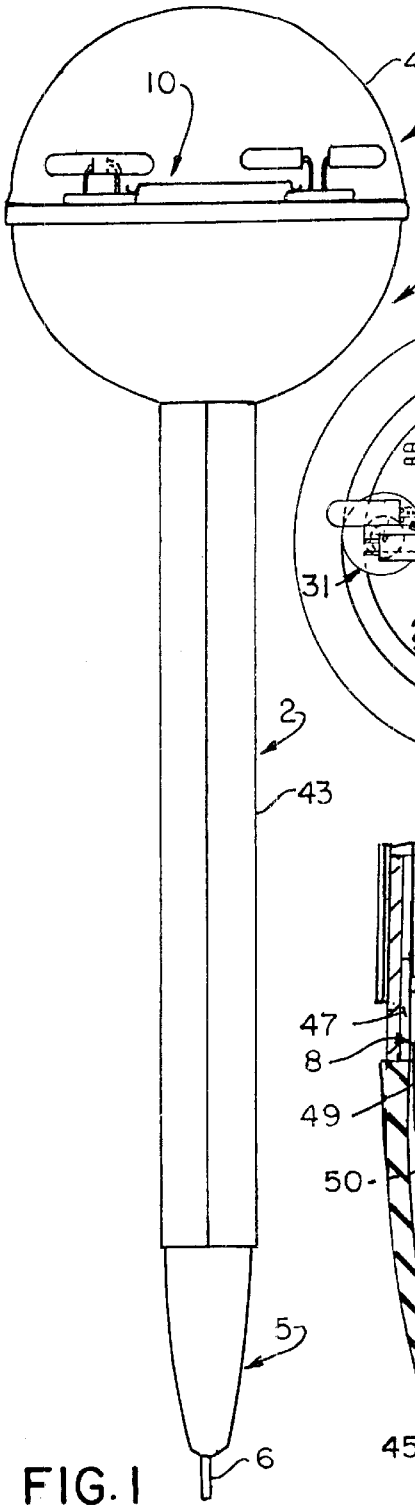
FIG. 1 is a view in side elevation of one embodiment of assembled light display device of this invention.
Figure 2:
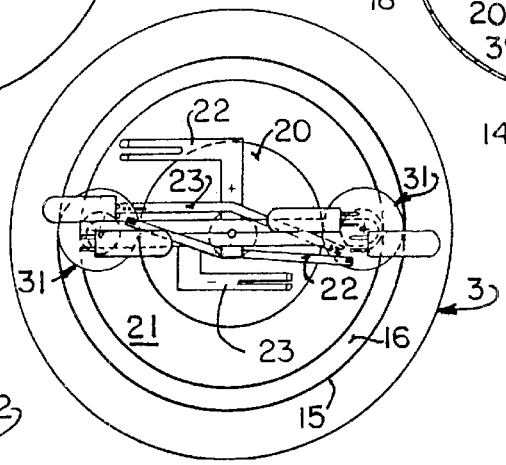
FIG. 2 is a slightly enlarged top plan view of the device shown in FIG. 1.
Figure 3:
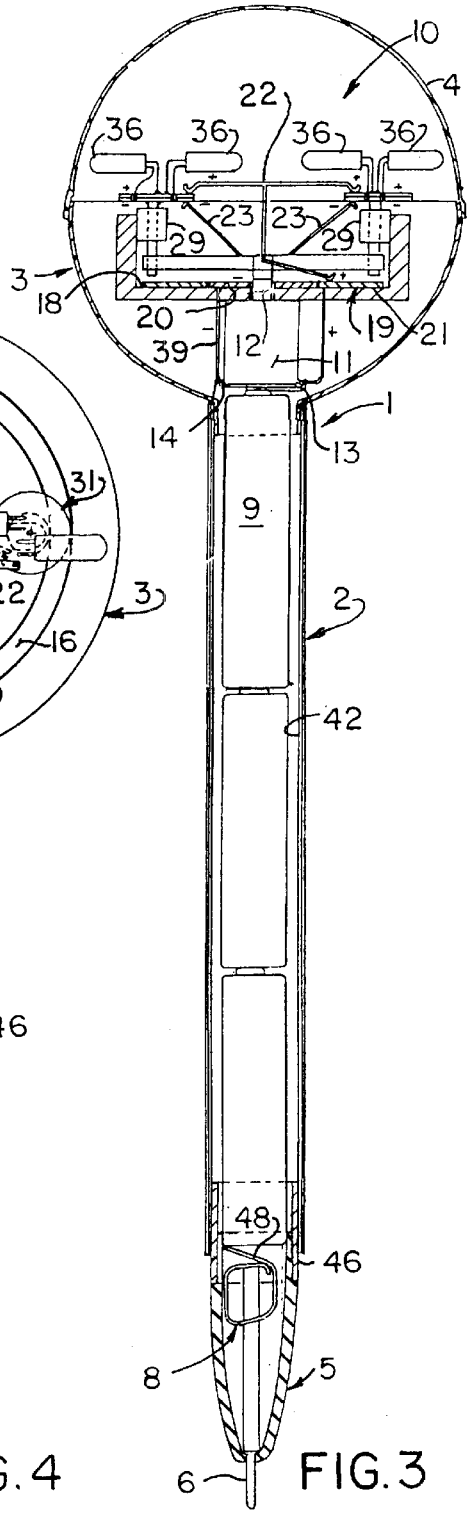
FIG. 3 is a longitudinal sectional view, an electrical system being shown somewhat schematically, of the device shown in FIGS. 1 and 2.
Figure 8:
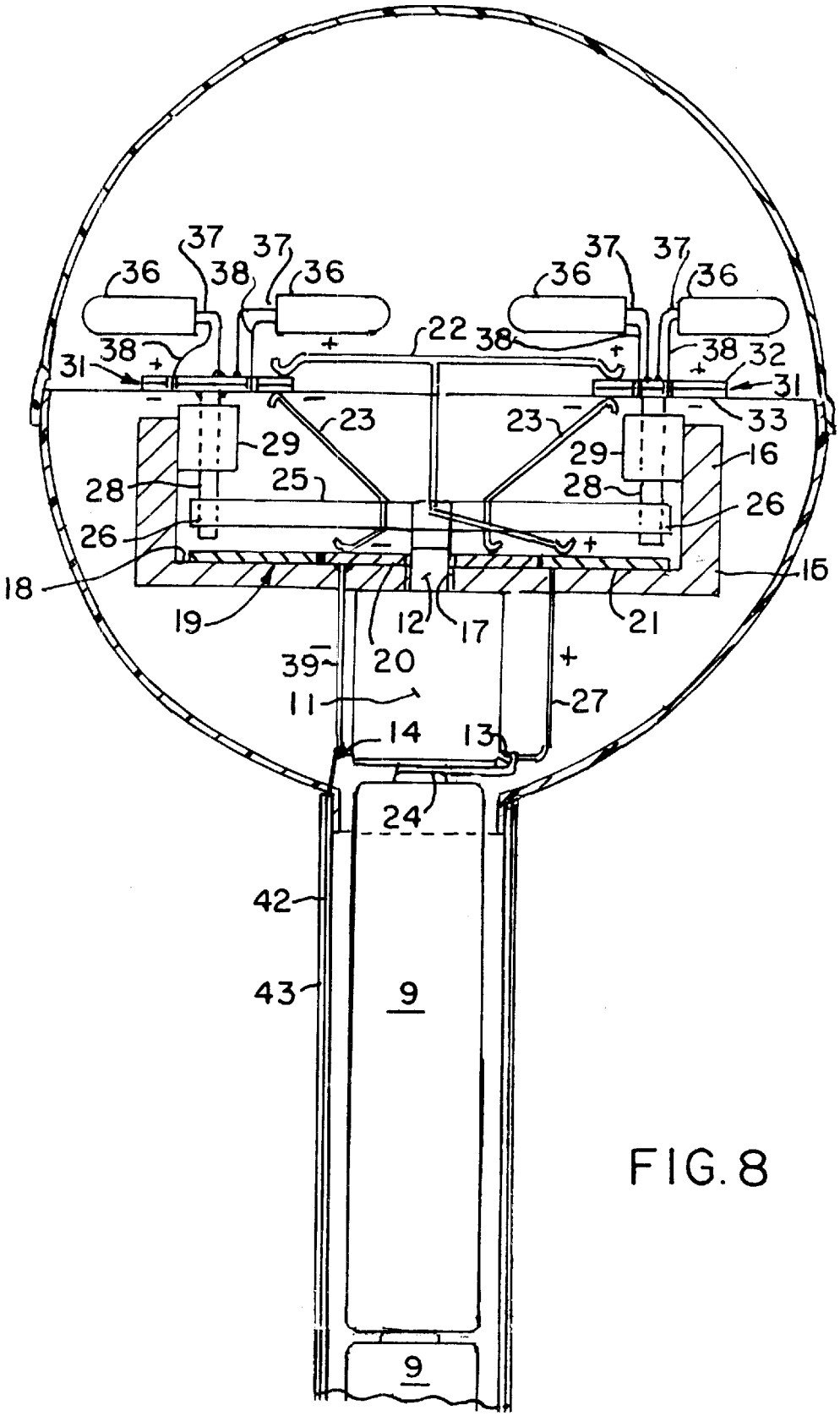
FIG. 8 is an enlarged view of the upper end of the device shown in FIGS. 1–3.

Referring now to FIGS. 1–4, and 8, for one illustrative embodiment of this invention, reference numeral 1 indicates the completed assembled device. The device 1 has a barrel 2, a dome 3 with a transparent hemisphere 4, a point capsule 5 with a ball point pen point 6 projecting from it and a cartridge-plunger 7 inside, along with a switch 8. Batteries 9, electrically coupled in series, are contained within the barrel 2. A light display 10 is carried by the barrel inside the dome. The light display 10 includes a motor 11 with a motor shaft 12 projecting axially with respect to the barrel 2. The motor has motor terminals 13 and 14. A fixed cup 15, with a rim 16, has a shaft opening 17, through which the shaft 12 projects. The cup 15, which is fixedly mounted against rotation with respect to the motor 11, barrel 2, and dome 3, has an inner bottom surface 18, in which a fixed disc 19 is mounted. The fixed disc 19 is made up of two concentric bands of electrically conductive material, a negative band 20 and a positive band 21, electrically separated by either an air gap or an annular strip of electrically non-conductive material. A positive brush or sliding contact 22 is in electrical contact at one end with the positive band 21 of the disc 19, and at another end, is in contact with a positive upper conductive surface 32 of lamp discs 31. A negative brush 23 has one end in electrical contact with the negative band 20 of the disc 19, and another end in contact with a lower conductive surface 33 of the lamp discs 31. The surfaces 32 and 33 are separated by an electrically insulative intermediate material. Each of the lamp discs 31 is carried by a shaft 28 journaled for rotation in a journal of an arm 25. The arm 25 is connected to be rotated by the shaft 12 of the motor 11. Each shaft 28 carries a roller 29 which is in frictional engagement with an inner surface of the rim 16, so that when the arm 25 is rotated, the shafts 28, hence the discs 31 are rotated. In FIGS. 3 and 8, for clarity, the arm 25 and discs 31 are shown spaced vertically somewhat farther apart than in actual practice, and the brushes 22 and 23 are shown somewhat schematically; their actual appearance is shown in FIG. 2. Lamps 36 are mounted on the discs 31, and are connected by means of electrical conductors 37 and 38 to the upper surface 32 and lower surface 33 respectively.

A positive contact of the contiguous battery 9 is electrically in contact with a conductor connected to a positive motor terminal 13, and, by way of a conductor 27, to the positive band of the conducting disc 19.

In this embodiment, the barrel 43 is made up of a conductive cylindrical casing 42 and an insulating wrapper 43. An electrical conductor 39 is electrically connected to the conductive casing 42, to a negative motor terminal 13 and to the negative band 20 of the disc 19.

Figure 4:
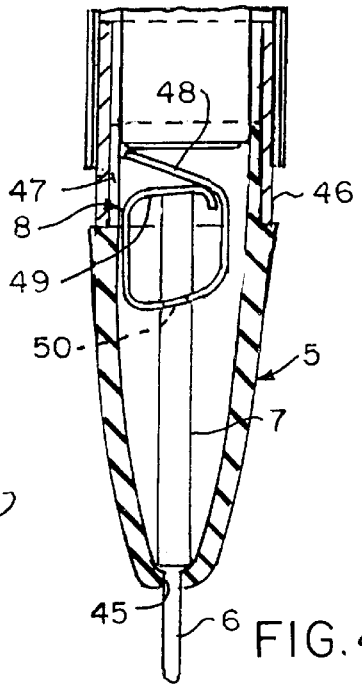
FIG. 4 is an enlarged, fragmentary sectional view of a lower end of the device shown in FIGS. 1 and 3.

Referring now to FIG. 4, the capsule 5 has at its lower end an opening 45 through which the pen point 6 extends, the opening being sized so as to retain the cartridge 7 within the capsule 5. In the illustrative embodiment shown, a simple switch mechanism 8 is illustrated, consisting of a strip of brass or other conductive but springy material, with a lower reach through which an opening 50 extends to receive slidably the cartridge 7, a switch terminal arm 48, and a spring arm 49, a rounded end of which bears against the underside of the terminal arm 48. The upper end of the cartridge 7 bears against an under surface of the spring arm 49. The capsule 5 is made of plastic, and is electrically insulative. It is stepped inwardly at its upper end to accommodate a band 46 of electrically conductive material, and to provide a lip to bear against the lower edge of the barrel 2. A slot 47 dimensioned and positioned to permit the passage of a free end of the terminal arm 48, permits that end to come into contact with the conductive band 46, which in turn is in close electrical contact with the conductive casing 42 of the barrel 2. At the same time, the switch terminal arm 48 is in constant electrical contact with the negative end of the batteries 9, so that when the terminal arm 48 is moved into engagement with the band 46, a circuit is completed to the battery and to the lamps 36. Clearly, numerous types of switch mechanisms can be employed; the one illustrated is merely one example of a simple, economical switch.

In operation, in the condition shown in FIG. 4, the point 6 is fully extended, and the switch terminal arm 48 is retracted from contact with the conductive band 46. When the point 6 is pushed inwardly with respect to the capsule 5, the upper end of the cartridge moves the arm 49, hence the terminal arm 48, to a position in which the terminal arm 48 comes into contact with both the negative end of the battery and the inner surface of the conductive band 46, which completes the circuit to the motor and to the lights. The motor shaft 12 begins to revolve, which rotates the arm 25, which causes the rollers 29 to rotate by virtue of their frictional engagement with the inner surface of the rim 16, which causes the discs 31 to rotate, hence the lamps 36, which are illuminated because of the completion of their circuit. The lamps 36 rotate about the axis of the shaft 12 as well as about the axis of each of the shafts 28, so that they describe a compound pattern of light display. In practice, by way of illustration, the entire device of this embodiment can be slightly less than 24 centimeters from tip to top, the dome at its greatest diameter, about 6½ centimeters, and the barrel about 1½ centimeters wide.

Figure 5:
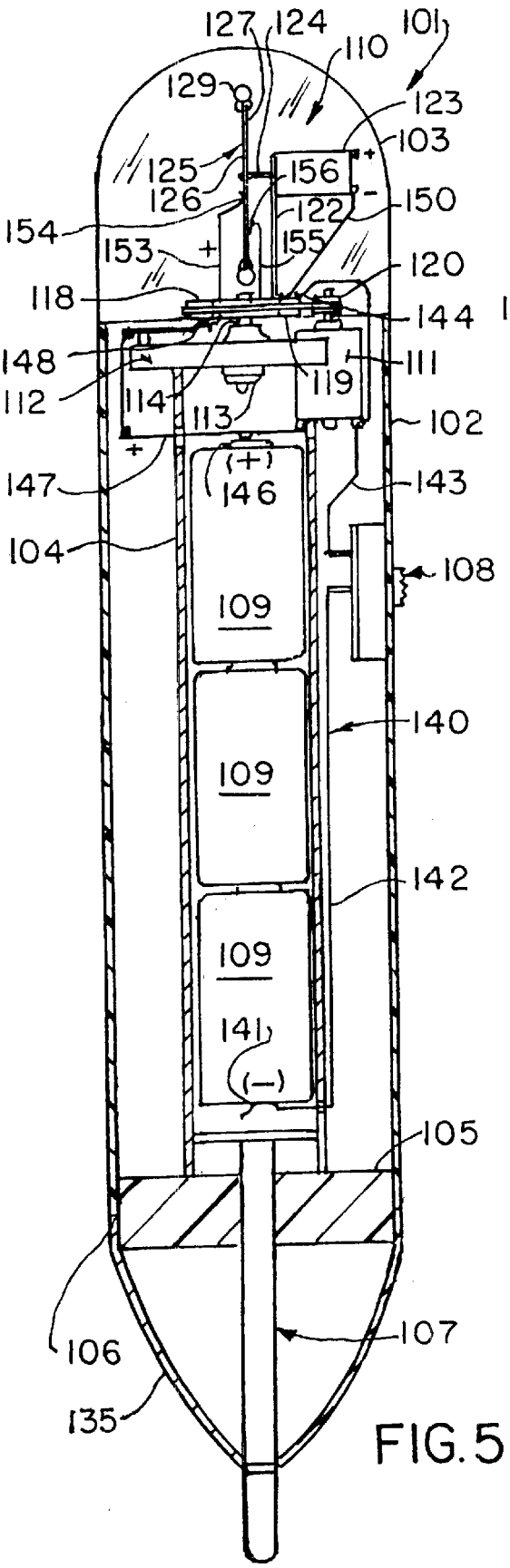
FIG. 5 is a longitudinal sectional view of a second embodiment of light display device of this invention.
Figure 6:
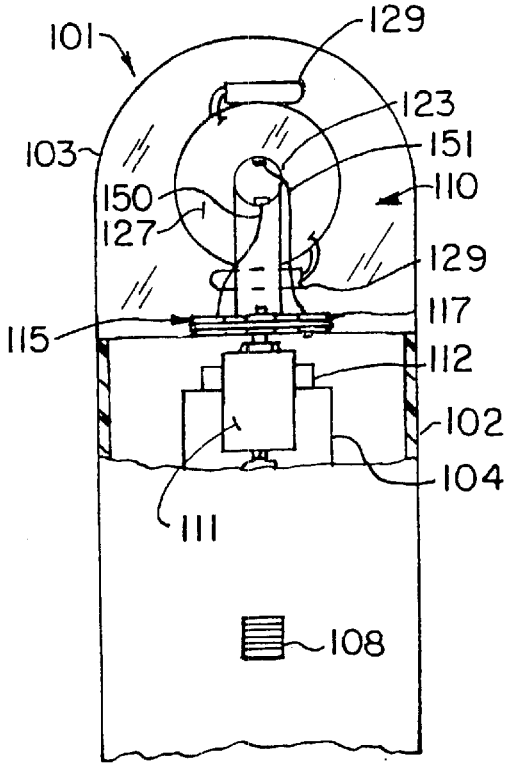
FIG. 6 is a fragmentary view, partly broken away, of the device shown in FIG. 5, at ninety degrees from the view in FIG. 5.
Figure 7:
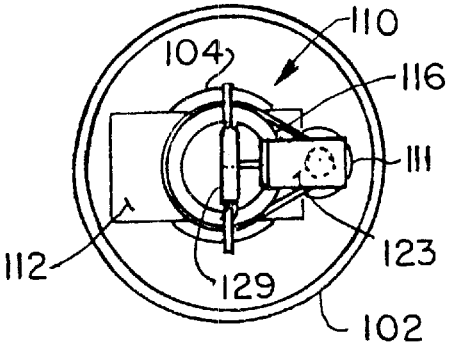
FIG. 7 is a top plan view of the device shown in FIGS. 5 and 6.

Referring now to FIGS. 5–7 for another embodiment of this invention, reference numeral 101 indicates the completed device. In this embodiment, an outer barrel 102 is made of plastic or other electrically insulative material. It is topped with a transparent dome 103, which in this case consists of a cylindrical side wall and a hemispherical dome, all of which is transparent. The barrel has at its lower end a capsule 135, from which a ball-point pen projects. However, in this embodiment, the ball point pen can have a conventional mechanism indicated schematically as 107, aligned and supported by a relatively thick annular base 105, which also serves as a closure for the barrel 102 and the capsule 135, which have a tight but removable fit on the base 105, meeting at a parting line 106. In this embodiment, the switching is not dependent upon movement of the ball-point mechanism. An inner barrel 104 is mounted on the annular base 105, and can also be made of electrically insulative material. Batteries 109 are mounted in the inner barrel 142. In this embodiment, a switch 108 is mounted in the outer barrel 102 in such a way as to permit it to be manually operated, and is electrically connected to the negative end of the batteries 109 by a spring contact 141 electrically connected to a conductor 142. A platform 112 is mounted on an upper end of the barrel 104. The platform 112 supports a light display 110. The light display 110 includes a first motor 111, mounted on the platform and barrel 104, as shown particularly in FIG. 5. The platform also carries a journal bearing 113, in which a shaft 114 is journaled for rotation. The shaft 114 carries a platform disc 115. The first motor 111 has a motor shaft on which a sheave 120 is mounted. The platform disc 115 has a groove around its perimeter. A pulley belt 116 extends around the sheave 120 and the peripheral groove in the disc 115, to rotate the disc 115 on the shaft 114. The disc 115 has an upper conducting surface 118 and a lower conducting surface 119, and an intermediate electrically non-conductive layer between the two surfaces.

A mounting bracket 122 is secured to the disc 115, projecting upwardly into the dome 103. The mounting bracket 122 carries a second motor 123 oriented with a shaft 124 rotating about an axis perpendicular to the axis of the shaft of the first motor 111 and the shaft 114. The shaft 124 of the motor 123 carries a light disc 125, which, like the disc 115, has an electrically conductive front side 126 and an electrically conductive back side 127, with a layer of non-conductive material between them. Lamps 129 are mounted on the periphery of disc 125, with electrical connections to the front and back surfaces of the disc.

A negative conductor 143 is connected to a second side of the switch 108, to a negative terminal of the motor 111, and to a brush contact with the upper side 118 of the disc 115. A positive conductor 147 is in electrical contact with the positive end of the upper battery 109, with a positive terminal of the motor 111, and with the lower surface 119 of the disc 115. A positive conductor 153 is connected to the lower surface of the disc 115, and at another end, is in sliding contact with the front face 126 of the light disc 125. A conductor 155 is electrically connected at one end to the upper surface 118 of the disc 115 and at its upper end 156 is in sliding contact with the back side 127 of the disc 125.

A negative terminal of the motor 123 is connected to the upper surface of the disc 115, by a conductor 150. A positive terminal of the motor 123 is connected, through an opening in the disc, to the lower surface 119 of the disc 115 by means of a conductor 151.

In operation, when the switch 108 is thrown to connect the negative end of the batteries to the conductor 143, both motors are energized, causing the disc 115 to be rotated and the disc 125 to be rotated, and the lamps 129 energized. The rotation of the lamps in a plane parallel to the axis of the shaft 114 and perpendicular to the plane of the disc 115, creates a three dimensional display.

In the device illustrated, the plane of the disc 125 is aligned with the axis of rotation of the shaft 114. However, it can be seen that if the bracket 122 is moved or so arranged as to make the plane of the disc 125 offset with respect to the axis of rotation of the shaft 114, a different effect will be produced. It can also be seen that two or more of such second motors 123 and discs 125 can be provided, both offset from the center line of the disc 115, giving yet a different effect. A second disc or even a third disc, equipped with lamps, can be carried by the shaft 124 of the second motor 123, to produce yet another effect.

Numerous variations in the construction of the device of this invention, within the scope of the appended claims, will occur to those skilled in the art in the light of the foregoing disclosure. For example, the lamps 36 of the first embodiment can be differently arranged, and either more discs on which lamps are mounted or different numbers of lamps on the same discs can be used. Different combinations of switches can also be used, so as to permit selective use of the light display device when the pen of the first embodiment is employed, or permitting the circuit of the second embodiment to be closed only when the pen point of the pen mechanism 107 is actuated. As has been indicated, different forms of hand-held device can be used, with different shapes or varieties of handle or dome, or with light displays at two ends or with a handle in the form of a crank, with a sleeve in which a center reach is journaled for rotation and one or more arms carrying at their ends light displays, so that when the handle is rotated in the sleeve, the entire light display moves in a circular path. The handles of these latter types form parts of hand held devices different from writing instruments. The lamp carriers can be inverted, and the barrel made transparent, so that the light display appears near the center, axially, of the barrel. The light disc of the first embodiment can be set vertically (axially) instead of at right angles to the long axis of the barrel. Different kinds of batteries can be used. The two embodiments described can be combined, the horizontal disc carrying lamps as well as the motor bracket. The rollers of the first embodiment can be replaced by gears, engaging gear teeth on the inner surface of the rim 16, to provide a positive drive instead of the frictional one. A gear on the motor shaft and teeth on the perimeter of the horizontal disc, with or without intermediate gears, can be used instead of the belt of the second embodiment. These variations are merely illustrative.

What is claimed is:

1. An amusement device comprising a first support mounted for rotation about a first support axis, means for rotating said first support about said axis, a light display mounted on said first support for rotation about a light display axis perpendicular to said first support axis, and means for rotating said light display about said light display axis, said means for rotating said light display comprising a second motor, mounted on said disc for rotation therewith.

2. A portable, hand-held light display device comprising an elongated, handle by which the device is held, said handle having a long axis, a transparent enclosure mounted on said handle, and a light display, mounted for rotation on said handle on an axis parallel to said long axis, visible through said transparent enclosure, said light display comprising a first rotating support and means for rotating said first support, at least one light support rotatably mounted on said first support, lamps mounted on said light support, and means for rotating said light support with respect to said first support when said first support is rotated.

3. An amusement device comprising a barrel having a long axis, a plunger mounted in an open end of said barrel for axial movement with respect to said barrel, a switch mounted to be closed and opened in response to said axial movement of said plunger, battery means electrically connected to said switch, and light display means comprising a plurality of lamps, rotatably mounted at a place spaced axially of said barrel from said plunger, and electrically connected to said battery means to be energized thereby when said switch is closed, an electric motor, electrically connected to said battery means through said switch, to be energized when said switch is closed, said motor being operatively connected to rotate said light display means, said light display means further including a first support mounted to be rotated by said motor about a motor shaft axis, a plurality of lamp supports rotatably mounted on said first support for rotation independent of said first support, lamps mounted on said lamp supports, and means for rotating said lamp supports when said first support is rotated by said motor, said lamp supports being rotated about an axis oriented perpendicularly to the axis of rotation of said first support.

4. The device of claim 3 wherein said barrel comprises a part of a ball-point pen, and said plunger is a ball point pen cartridge.

5. An amusement device comprising a barrel having a long axis, a switch mounted on said barrel, battery means electrically connected to said switch, an electric motor mounted in said barrel and electrically connected to said switch, said motor having a rotating shaft with an axis of rotation generally parallel to the said long axis of the barrel, and a light display comprising a first support mounted to be rotated by said motor about said motor shaft axis, a second support mounted on said first support for rotation on a light display axis perpendicular to the said first motor shaft axis, a plurality of lamps, mounted on said second support and electrically connected to said battery means to be energized thereby when said switch is closed, and means for rotating said second support with respect to said first support when said first support is rotated.

6. The amusement device of claim 5 wherein said means for rotating said light display means comprises a second electric motor, electrically connected to said battery means.

7. The device of claim 5 wherein the light display is enclosed by a transparent dome.

* * * * *